US008528664B2

(12) United States Patent
Hall et al.

(10) Patent No.: US 8,528,664 B2
(45) Date of Patent: Sep. 10, 2013

(54) DOWNHOLE MECHANISM

(75) Inventors: David R. Hall, Provo, UT (US); John Bailey, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 13/170,374

(22) Filed: Jun. 28, 2011

(65) Prior Publication Data

US 2012/0097453 A1 Apr. 26, 2012

Related U.S. Application Data

(63) Continuation of application No. 12/039,635, filed on Feb. 28, 2008, now Pat. No. 7,967,082, which is a continuation of application No. 12/039,608, filed on Feb. 28, 2008, now Pat. No. 7,762,353, which is a continuation-in-part of application No. 12/037,682, filed on Feb. 26, 2008, now Pat. No. 7,624,824, which is a continuation-in-part of application No. 12/019,782, filed on Jan. 25, 2008, now Pat. No. 7,617,886, which is a continuation-in-part of application No. 11/837,321, filed on Aug. 10, 2007, now Pat. No. 7,559,379, which is a continuation-in-part of application No. 11/750,700, filed on May 18, 2007, now Pat. No. 7,549,489, which is a continuation-in-part of application No. 11/737,034, filed on Apr. 18, 2007, now Pat. No. 7,503,405, which is a continuation-in-part of application No. 11/686,638, filed on Mar. 15, 1997, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, now Pat. No. 7,600,586, said application No. 13/170,374 is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196, said application No. 13/170,374 is a continuation-in-part of application No. 11/555,334, filed on Nov. 1, 2006, now Pat. No. 7,419,018.

(51) Int. Cl.
*E21B 7/24* (2006.01)

(52) U.S. Cl.
USPC ..... 175/56

(58) Field of Classification Search
USPC ..... 175/56, 296, 297, 299, 317
See application file for complete search history.

(56) References Cited

U.S. PATENT DOCUMENTS

| | | | |
|---|---|---|---|
| 465,103 | A | 12/1891 | Wegner |
| 616,118 | A | 12/1898 | Kunhe |
| 923,513 | A | 6/1909 | Hardsocg |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,372,257 | A | 3/1921 | Swisher |
| 1,367,733 | A | 6/1921 | Midgett |
| 1,387,733 | A | 8/1921 | Midgett |
| 1,460,671 | A | 7/1923 | Habsacker |
| 1,544,757 | A | 7/1925 | Hufford |

1,619,328 A 3/1927 Benckenstein
1,746,455 A 2/1930 Woodruff et al.
1,746,456 A 2/1930 Allington
1,621,474 A 9/1931 Mercer
1,821,474 A 9/1931 Mercer
1,836,638 A 12/1931 Wright et al.
1,879,177 A 9/1932 Gault
2,022,101 A 11/1935 Wright
2,054,255 A 9/1936 Howard
2,064,255 A 12/1936 Garfield
2,100,692 A 11/1937 Harman
2,169,223 A 8/1939 Christian
2,196,940 A 4/1940 Potts
2,216,130 A 10/1940 Court
2,227,233 A 12/1940 Scott et al.
2,300,016 A 10/1942 Scott et al.
2,320,136 A 5/1943 Kammerer
2,345,024 A 3/1944 Bannister
2,371,248 A 3/1945 McNamara
2,375,335 A 5/1945 Walker
2,465,060 A * 3/1949 Carlisle et al. ..... 417/112
2,466,991 A 4/1949 Kammerer
2,498,192 A 2/1950 Wright
2,540,464 A 2/1951 Stokes
2,544,036 A 3/1951 Kammerer
2,545,036 A 3/1951 Kammerer
2,575,173 A 11/1951 Johnson
2,619,325 A 1/1952 Arutunoff
2,626,780 A 1/1953 Ortloff
2,643,860 A 6/1953 Koch
2,725,215 A 11/1955 Macneir
2,735,653 A 2/1956 Bielstein
2,746,721 A 5/1956 Moore
2,755,071 A 7/1956 Kammerer
2,776,819 A 1/1957 Brown
2,807,443 A 9/1957 Wyman
2,819,041 A 1/1958 Beckham
2,819,043 A 1/1958 Henderson
2,838,284 A 6/1958 Austin
2,868,511 A 1/1959 Barrett
2,873,093 A 2/1959 Hildebrandt et al.
2,877,984 A 3/1959 Causey
2,894,722 A 7/1959 Buttolph
2,901,223 A 8/1959 Scott
2,942,850 A 6/1960 Heath
2,942,851 A 6/1960 Beck
2,963,102 A 12/1960 Smith
2,998,085 A 8/1961 Dulaney
3,036,645 A 5/1962 Rowley
3,055,443 A 9/1962 Edwards
3,058,532 A 10/1962 Alder
3,075,592 A 1/1963 Overly et al.
3,077,936 A 2/1963 Arutunoff
3,105,560 A 10/1963 Zublin
3,135,341 A 6/1964 Ritter
3,139,147 A 6/1964 Hays et al.
3,163,243 A 12/1964 Cleary
3,199,617 A 8/1965 White
3,216,514 A 11/1965 Nelson
3,251,424 A 5/1966 Brooks
3,294,186 A 12/1966 Buell
3,301,339 A 1/1967 Pennebaker, Jr.
3,303,899 A 2/1967 Jones, Jr. et al.
3,336,988 A 8/1967 Jones, Jr.
3,346,060 A 10/1967 Rex
3,379,264 A 4/1968 Cox
3,387,673 A 6/1968 Thompson
3,429,390 A 2/1969 Bennett
3,433,331 A 3/1969 Heyberger
3,455,158 A 7/1969 Richter et al.
3,493,165 A 2/1970 Schofield
3,583,504 A 6/1971 Aalund
3,635,296 A 1/1972 Lebourg
3,700,049 A 10/1972 Tiraspolsky et al.
3,732,143 A 5/1973 Joosse
3,764,493 A 10/1973 Rosar
3,807,512 A 4/1974 Pogonowski et al.
3,815,692 A 6/1974 Varley
3,821,993 A 7/1974 Kniff
3,885,638 A 5/1975 Skidmore et al.
3,899,033 A 8/1975 Huisen
3,955,635 A 5/1976 Skidmore
3,960,223 A 6/1976 Kleine
3,978,931 A 9/1976 Sudnishnikov et al.
4,081,042 A 3/1978 Johnson
4,096,917 A 6/1978 Harris
4,106,577 A 8/1978 Summer
4,165,790 A 8/1979 Emmerich
4,176,723 A 12/1979 Arceneaux
4,253,533 A 3/1981 Baker
4,262,758 A 4/1981 Evans
4,280,573 A 7/1981 Sudnishnikov
4,304,312 A 12/1981 Larsson
4,307,786 A 12/1981 Evans
4,386,669 A 6/1983 Evans
4,397,361 A 8/1983 Langford
4,416,339 A 11/1983 Baker
4,445,580 A 5/1984 Sahley
4,448,269 A 5/1984 Ishikawa
4,478,296 A 10/1984 Richman
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,583,592 A 4/1986 Gazda et al.
4,592,432 A 6/1986 Williams et al.
4,597,454 A 7/1986 Schoeffler
4,612,987 A 9/1986 Cheek
4,615,399 A 10/1986 Schoeffler
4,624,306 A 11/1986 Traver et al.
4,637,479 A 1/1987 Leising
4,640,374 A 2/1987 Dennis
4,679,637 A 7/1987 Cherrington
4,683,781 A 8/1987 Kar et al.
4,732,223 A 3/1988 Schoeffler
4,775,017 A 10/1988 Forrest et al.
4,817,739 A 4/1989 Jeter
4,819,745 A 4/1989 Walter
4,821,819 A 4/1989 Whysong
4,830,122 A 5/1989 Walter
4,836,301 A 6/1989 Van Dongen et al.
4,852,672 A 8/1989 Behrens
4,889,017 A 12/1989 Fuller
4,889,199 A 12/1989 Lee
4,907,665 A 3/1990 Kar et al.
4,962,822 A 10/1990 Pascale
4,974,688 A 12/1990 Helton
4,979,577 A 12/1990 Walter
4,981,184 A 1/1991 Knowlton
4,991,667 A 2/1991 Wilkes et al.
4,991,670 A 2/1991 Fuller
5,009,273 A 4/1991 Grabinski
5,027,914 A 7/1991 Wilson
5,038,873 A 8/1991 Jurgens
5,052,503 A 10/1991 Lof
5,088,568 A 2/1992 Simuni
5,094,304 A 3/1992 Briggs
5,099,927 A 3/1992 Gibson et al.
5,103,919 A 4/1992 Warren et al.
5,119,892 A 6/1992 Clegg
5,135,060 A 8/1992 Ide
5,141,063 A 8/1992 Quesenbury
5,148,875 A 9/1992 Karlsson et al.
5,163,520 A 11/1992 Gibson et al.
5,176,212 A 1/1993 Tandberg
5,186,268 A 2/1993 Clegg
5,222,566 A 6/1993 Taylor
5,255,749 A 10/1993 Bumpurs
5,259,469 A 11/1993 Stjernstrom et al.
5,265,682 A 11/1993 Russell
5,311,953 A 5/1994 Walker
5,314,030 A 5/1994 Peterson et al.
5,361,859 A 11/1994 Tibbitts
5,388,649 A 2/1995 Ilomaki
5,410,303 A 4/1995 Comeau
5,415,030 A 5/1995 Jogi et al.

5,417,292 A 5/1995 Polakoff
5,423,389 A 6/1995 Warren
5,443,128 A 8/1995 Amaudric du Chaffaut
5,475,309 A 12/1995 Hong et al.
5,499,687 A * 3/1996 Lee ..... 175/317
5,507,357 A 4/1996 Hult
5,553,678 A 9/1996 Barr et al.
5,560,440 A 10/1996 Tibbitts
5,568,838 A 10/1996 Struthers
5,642,782 A 7/1997 Grimshaw
5,655,614 A 8/1997 Azar
5,678,644 A 10/1997 Fielder
5,720,355 A 2/1998 Lamine et al.
5,732,784 A 3/1998 Nelson
5,758,731 A 6/1998 Zollinger
5,758,732 A 6/1998 Liw
5,778,991 A 7/1998 Runquist et al.
5,794,728 A 8/1998 Palmberg
5,806,611 A 9/1998 Van Den Steen
5,833,021 A 11/1998 Mensa-Wilmot et al.
5,864,058 A 1/1999 Chen
5,896,938 A 4/1999 Moeny
5,901,113 A 5/1999 Masak et al.
5,901,796 A 5/1999 McDonald
5,904,444 A 5/1999 Kabeuchi et al.
5,924,499 A 7/1999 Birchak et al.
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,047,239 A 4/2000 Berger et al.
6,050,350 A 4/2000 Morris et al.
6,089,332 A 7/2000 Barr et al.
6,092,610 A 7/2000 Kosmala et al.
6,131,675 A 10/2000 Anderson
6,150,822 A 11/2000 Hong
6,161,631 A 12/2000 Kennedy et al.
6,186,251 B1 2/2001 Butcher
6,202,761 B1 3/2001 Forney
6,213,225 B1 4/2001 Chen
6,213,226 B1 4/2001 Eppink
6,223,824 B1 5/2001 Moyes
6,269,893 B1 8/2001 Beaton
6,296,069 B1 10/2001 Lamine
6,298,930 B1 10/2001 Sinor
6,321,858 B1 11/2001 Wentworth et al.
6,340,064 B2 1/2002 Fielder
6,363,780 B1 4/2002 Rey-Fabret
6,364,034 B1 4/2002 Schoeffler
6,364,038 B1 4/2002 Driver
6,394,200 B1 5/2002 Watson
6,439,326 B1 8/2002 Huang
6,443,249 B2 9/2002 Beuershausen
6,450,269 B1 9/2002 Wentworth et al.
6,454,030 B1 9/2002 Findley et al.
6,466,513 B1 10/2002 Pabon et al.
6,467,341 B1 10/2002 Boucher et al.
6,474,425 B1 11/2002 Truax
6,484,819 B1 11/2002 Harrison
6,484,825 B2 11/2002 Watson
6,502,650 B1 1/2003 Beccu
6,510,906 B1 1/2003 Richert
6,513,606 B1 2/2003 Krueger
6,533,050 B2 3/2003 Molloy
6,575,236 B1 6/2003 Heijnen
6,581,699 B1 6/2003 Chen et al.
6,588,518 B2 7/2003 Eddison
6,594,881 B2 7/2003 Tibbitts
6,601,454 B1 8/2003 Botnan
6,601,662 B2 8/2003 Matthias et al.
6,622,803 B2 9/2003 Harvey
6,668,949 B1 12/2003 Rives
6,670,880 B1 12/2003 Hall et al.
6,698,537 B2 3/2004 Pascale et al.
6,729,420 B2 5/2004 Mensa-Wilmot
6,732,817 B2 5/2004 Dewey
6,749,031 B2 6/2004 Klemm
6,789,635 B2 9/2004 Wentworth et al.
6,814,162 B2 11/2004 Moran et al.
6,820,697 B1 11/2004 Churchill
6,822,579 B2 11/2004 Goswani
6,880,648 B2 4/2005 Edscer
6,913,095 B2 7/2005 Krueger
6,929,076 B2 8/2005 Fanuel et al.
6,948,572 B2 9/2005 Hay et al.
6,953,096 B2 10/2005 Gledhill
6,994,175 B2 2/2006 Egerstrom
7,013,994 B2 3/2006 Eddison
7,025,155 B1 4/2006 Estes
7,073,610 B2 7/2006 Susman
7,096,980 B2 8/2006 Trevas
7,104,344 B2 9/2006 Kriesels
7,198,119 B1 4/2007 Hall et al.
7,204,560 B2 4/2007 Mercier et al.
7,207,398 B2 4/2007 Runia
7,225,886 B1 6/2007 Hall
7,240,744 B1 7/2007 Kemick
7,270,196 B2 9/2007 Hall
7,328,755 B2 2/2008 Hall et al.
7,337,858 B2 3/2008 Hall et al.
566,137 A1 4/2008 Hall et al.
7,360,610 B2 4/2008 Hall et al.
7,360,612 B2 4/2008 Chen et al.
7,367,397 B2 5/2008 Clemens et al.
572,735 A1 7/2008 Kammerer
7,398,837 B2 7/2008 Hall et al.
7,419,016 B2 9/2008 Hall et al.
7,419,018 B2 9/2008 Hall et al.
7,424,922 B2 9/2008 Hall et al.
7,426,968 B2 9/2008 Hall et al.
7,481,281 B2 1/2009 Schuaf
7,484,576 B2 2/2009 Hall et al.
7,497,279 B2 3/2009 Hall et al.
7,503,405 B2 3/2009 Hall et al.
7,506,701 B2 3/2009 Hall et al.
7,510,031 B2 3/2009 Russell et al.
7,549,489 B2 6/2009 Hall et al.
7,559,379 B2 7/2009 Hall et al.
7,571,780 B2 8/2009 Hall et al.
7,600,586 B2 10/2009 Hall et al.
7,617,886 B2 11/2009 Hall
7,624,824 B2 12/2009 Hall et al.
7,641,003 B2 1/2010 Hall et al.
7,694,756 B2 4/2010 Hall et al.
2001/0054515 A1 12/2001 Eddison et al.
2002/0050359 A1 5/2002 Eddison
2003/0213621 A1 11/2003 Britten
2004/0154839 A1 8/2004 McGarian et al.
2004/0222024 A1 11/2004 Edscer
2004/0238221 A1 12/2004 Runia
2004/0256155 A1 12/2004 Kriesels
2007/0079988 A1 4/2007 Konschuh et al.

OTHER PUBLICATIONS

Patent Cooperation Treaty, International Search Report and Written Opinion of the International Searching Authority for PCT/US07/64544, date of mailing Aug. 5, 2008.

Patent Cooperation Treaty, International Preliminary Report on Patentability, International Search Report and Written Opinion of the International Searching Authority for PCT/US06/43107, date of mailing Mar. 5, 2007, date of issuance May 27, 2008.

Patent Cooperation Treaty, International Preliminary Report on Patentability and Written Opinion of the International Searching Authority for PCT/US06/43125, date of mailing Jun. 4, 2007; and the International Search Report, dated Feb. 23, 2007, date of issuance May 27, 2008.

PCT International Preliminary Report on Patentability Chapter 1 for PCT/US07/64544, mailed Sep. 30, 2008.

* cited by examiner

*Primary Examiner* — Brad Harcourt
(74) *Attorney, Agent, or Firm* — Brinks Hofer Gilson & Lione

(57) ABSTRACT

A tubular downhole tool string component having a sidewall with a fluid passageway formed therein between a first end and second end, and a valve mechanism disposed within the fluid passageway adapted to substantially cyclically build-up and release pressure within the fluid passageway such that a pressure build-up results in radial expansion of at least a portion of the sidewall and wherein a pressure release results in a radial contraction of the portion of the sidewall. The valve mechanism disposed within the fluid passageway comprises a spring. Radial expansion and contraction of the portion of the sidewall varies a weight loaded to a drill bit disposed at a drilling end of the drill string.

17 Claims, 7 Drawing Sheets

DOWNHOLE MECHANISM

CROSS REFERENCE TO RELATED APPLICATIONS

This Patent application is a continuation of U.S. patent application Ser. No. 12/039,635, filed on Feb. 28, 2008, now U.S. Pat. No. 7,967,082, which is a continuation of U.S. patent application Ser. No. 12/039,608, filed on Feb. 28, 2008, now U.S. Pat. No. 7,762,353, which is a continuation-in-part of U.S. patent application Ser. No. 12/037,682, filed on Feb. 26, 2008, now U.S. Pat. No. 7,624,824, which is a continuation-in-part of U.S. patent application Ser. No. 12/019,782, filed on Jan. 25, 2008, now U.S. Pat. No. 7,617,886, which is a continuation-in-part of U.S. patent application Ser. No. 11/837,321, filed on Aug. 10, 2007, now U.S. Pat. No. 7,559,379, which is a continuation-in-part of U.S. patent application Ser. No. 11/750,700, filed on May 18, 2007, now U.S. Pat. No. 7,549,489, which is a continuation-in part of U.S. patent application Ser. No. 11/737,034, filed on Apr. 18, 2007, now U.S. Pat. No. 7,503,405, which is a continuation-in-part of U.S. patent application Ser. No. 11/686,638, filed on Mar. 15, 1997, now U.S. Pat. No. 7,424,922, which is a continuation-in-part of U.S. patent application Ser. No. 11/680,997, filed on Mar. 1, 2007, now U.S. Pat. No. 7,419,016, which is a continuation-in-part of U.S. patent application Ser. No. 11/673,872, filed on Feb. 12, 2007, now U.S. Pat. No. 7,484,576, which is a continuation-in-part of U.S. patent application Ser. No. 11/611,310, filed on Dec. 15, 2006, now U.S. Pat. No. 7,600,586. This Patent Application is also a continuation-in-part of U.S. patent application Ser. No. 11/278,935, filed on Apr. 6, 2006, now U.S. Pat. No. 7,426,968, which is a continuation-in-part of U.S. patent application Ser. No. 11/277,394, filed on Mar. 24, 2006, now U.S. Pat. No. 7,398,837, which is a continuation-in-part of U.S. patent application Ser. No. 11/277,380, filed on Mar. 24, 2006, now U.S. Pat. No. 7,337,858, which is a continuation-in-part of U.S. patent application Ser. No. 11/306,976, filed on Jan. 18, 2006, now U.S. Pat. No. 7,360,610, which is a continuation-in-part of U.S. patent application Ser. No. 11/306,307, filed Dec. 22, 2005, now U.S. Pat. No. 7,225,886, which is a continuation-in-part of U.S. patent application Ser. No. 11/306,022, filed Dec. 14, 2005, now U.S. Pat. No. 7,198,119, which is a continuation-in-part of U.S. patent application Ser. No. 11/164,391, filed Nov. 21, 2005, now U.S. Pat. No. 7,270,196. This Patent Application is also a continuation-in-part of U.S. patent application Ser. No. 11/555,334 which was filed on Nov. 1, 2006, now U.S. Pat. No. 7,419,018. All of these applications are herein incorporated by reference in their entirety.

BACKGROUND OF THE INVENTION

This invention relates to the field of downhole drill strings. Increasing the rate of penetration in drilling saves substantial amount of time and money in the oil and gas, geothermal, exploration, and horizontal drilling industries.

U.S. Pat. No. 6,588,518 to Eddison, which is herein incorporated by reference for all that it contains, discloses a downhole drilling method comprising the production of pressure pulses in drilling fluid using measurement-while-drilling (MWD) apparatus and allowing the pressure pulses to act upon a pressure responsive device to create an impulse force on a portion of the drill string.

U.S. Pat. No. 4,890,682 to Worrall, et al., which is herein incorporated by reference for all that it contains, discloses a jarring apparatus provided for vibrating a pipe string in a borehole. The apparatus thereto generates at a downhole location longitudinal vibrations in the pipe string in response to flow of fluid through the interior of said string.

U.S. Pat. No. 4,979,577 to Walter et al., which is herein incorporated by reference for all that it contains, discloses a flow pulsing apparatus adapted to be connected in a drill string above a drill bit. The apparatus includes a housing providing a passage for a flow of drilling fluid toward the bit. A valve which oscillates in the axial direction of the drill string periodically restricts the flow through the passage to create pulsations in the flow and a cyclical water hammer effect thereby to vibrate the housing and the drill bit during use. Drill bit induced longitudinal vibrations in the drill string can be used to generate the oscillation of the valve along the axis of the drill string to effect the periodic restriction of the flow or, in another form of the invention, a special valve and spring arrangement is used to help produce the desired oscillating action and the desired flow pulsing action.

BRIEF SUMMARY OF THE INVENTION

In one aspect of the invention, a downhole tool string component comprises a fluid passageway formed between a first and second end. A valve mechanism is disposed within the fluid passageway adapted to substantially cyclically build-up and release pressure within the fluid passageway such that a pressure build-up results in radial expansion of at least a portion of the fluid passageway and wherein a pressure release results in a contraction of the portion of the fluid passageway. The valve mechanism disposed within the fluid passageway comprises a spring. Expansion and contraction of the portion of the fluid passageway assisting in advancing the drill string within a subterranean environment. This advancing may be accomplished by varying a weight loaded to a drill bit disposed or helping to propel the drill string along a horizontal well.

The spring is adapted to oppose the travel of a fluid flow. The spring is a tension spring or a compression spring. The spring is disposed intermediate a carrier and a centralizer and is aligned coaxially with the downhole tool string component.

The valve mechanism comprises a shaft radially supported by a bearing and the centralizer. The carrier is mounted to the shaft. The centralizer is adapted to align the shaft coaxially with the downhole tool string component. The bearing is disposed intermediate the shaft and the centralizer. The carrier comprises at least one port. The carrier comprises a first channel formed on a peripheral edge substantially parallel with an axis of the tool string component.

The drilling fluid is adapted to push against a fluid engaging surface disposed on the carrier. The valve mechanism comprises an insert disposed intermediate and coaxially with the first end and the carrier. The centralizer and the insert are fixed within the fluid passageway. The insert comprises a taper adapted to concentrate the flow of the downhole tool string fluid into the carrier. The engagement of the fluid against the carrier resisted by the spring of the valve mechanism causes the first and second set of ports to align and misalign by oscillating the shaft. The insert further comprises a second channel on its peripheral edge. The valve mechanism comprises a fluid by-pass. The bit is adapted to cyclically apply pressure to the formation. The drill bit comprises a jack element with a distal end protruding from a front face of the drill bit and substantially coaxial with the axis of rotation of the bit.

DETAILED DESCRIPTION

Figure 1:
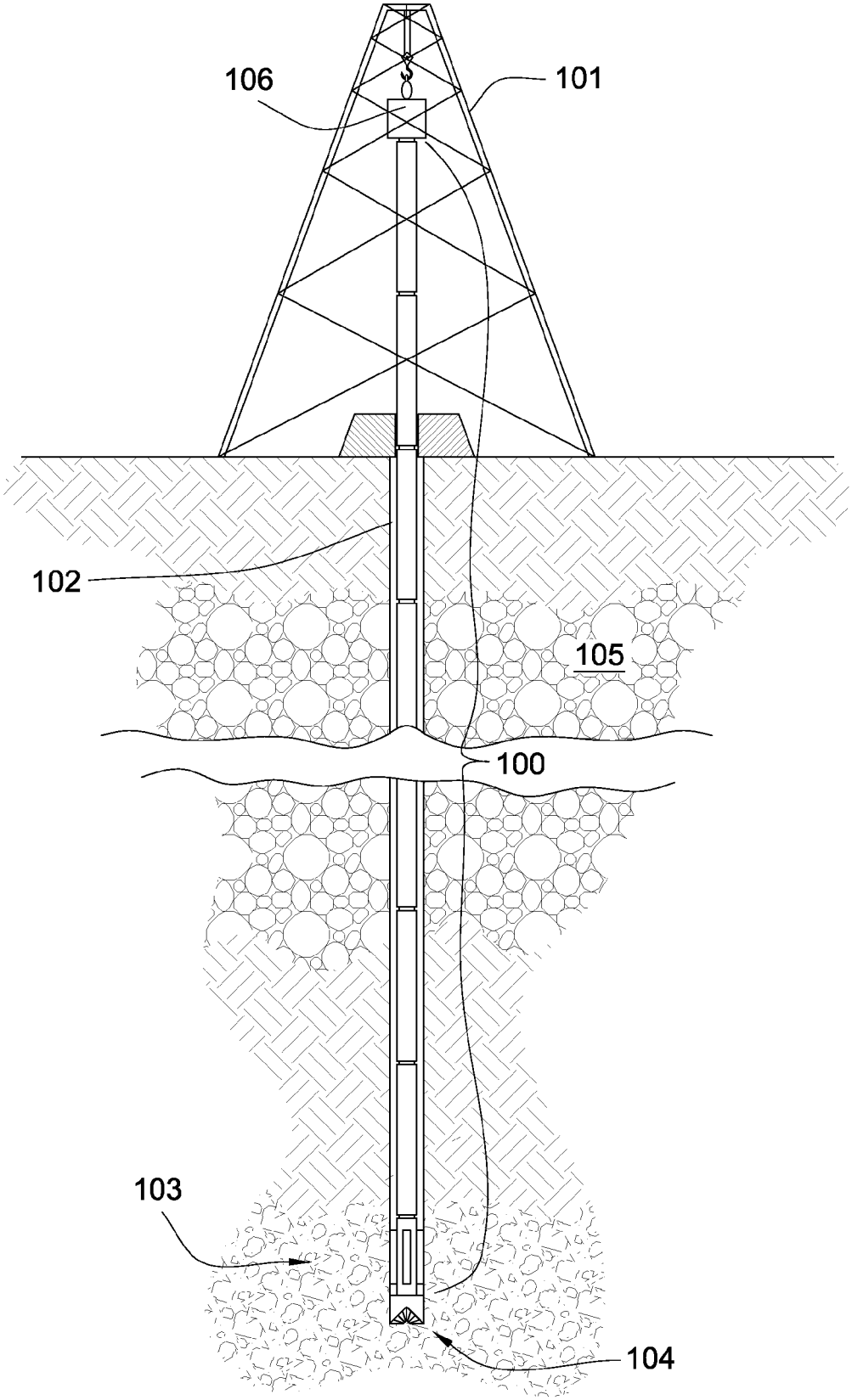
FIG. 1 is a perspective diagram of an embodiment of a string of downhole tools suspended in a borehole.

FIG. 1 is a perspective diagram of an embodiment of a string of downhole tools 100 suspended by a derrick 101 in a borehole 102. A bottomhole assembly 103 may be located at the bottom of the borehole 102 and may comprise a drill bit 104. As the drill bit 104 rotates downhole the tool string 100 may advance farther into the earth. The drill string 100 may penetrate soft or hard subterranean formations 105. The bottom hole assembly 103 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottomhole assembly 103. In some embodiments of the invention, no downhole telemetry system is used.

Figure 2:
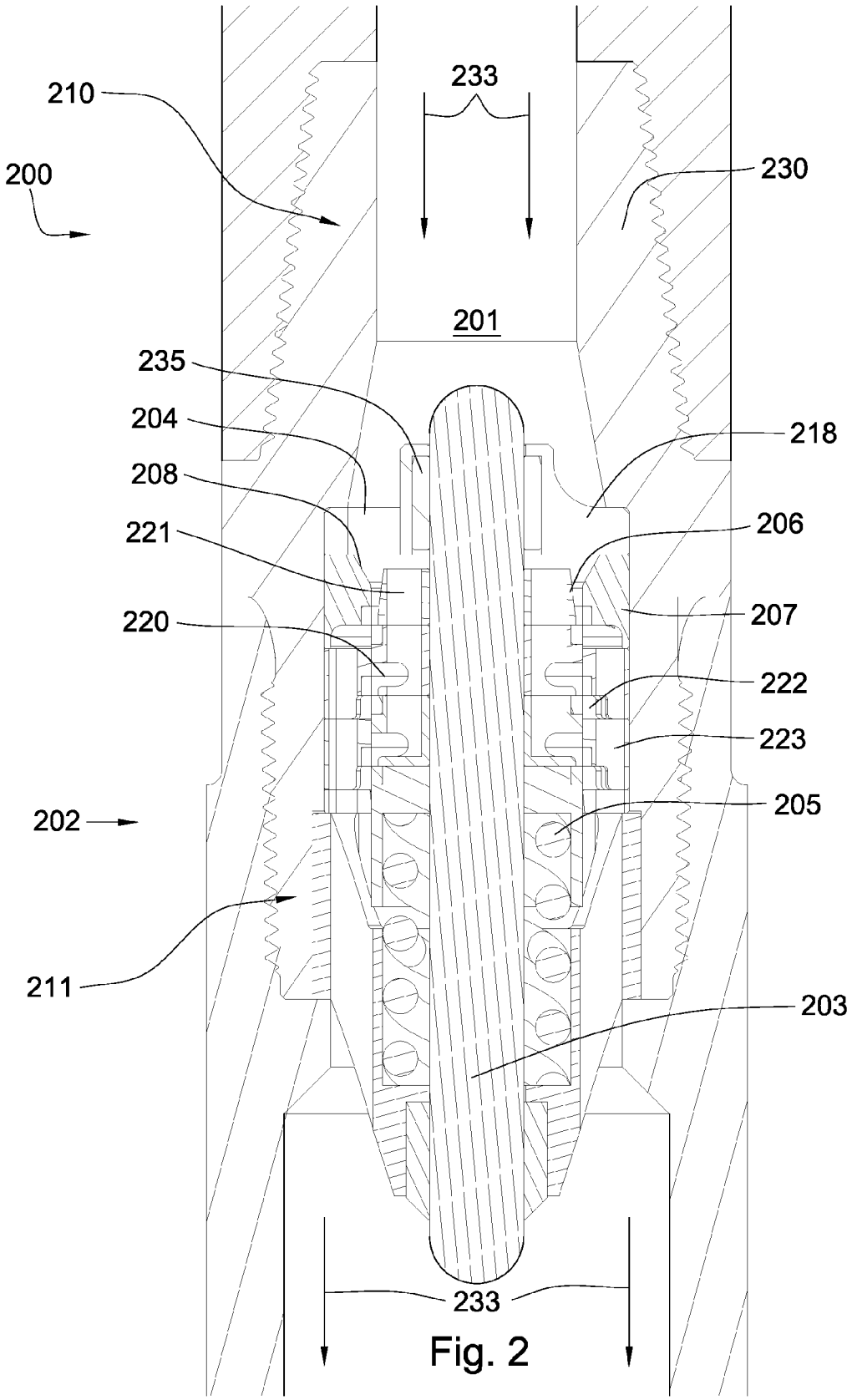
FIG. 2 is a cross-sectional diagram of an embodiment of a downhole tool string component.

FIG. 2 is a cross-sectional diagram of an embodiment of a downhole tool string component 200 comprised of a first end 210 and a second end 211. The central bore or fluid passageway 201 may comprise a valve mechanism 202. The valve mechanism 202 may comprise a shaft 203 aligned coaxially with the downhole tool string component 200 by a centralizer 218. The valve mechanism 202 may also comprise a fluid by-pass 204. The valve mechanism 202 may also comprise a spring 205 adapted to oppose the travel of a flow of drilling fluid. The drilling fluid may follow a path indicated by the arrows 233. The spring 205 may be aligned coaxially with the downhole tool string component 200 and may be a compression spring or a tension spring.

The valve mechanism 202 may also comprise a carrier 206 comprised of ports 220 and a first channel 221. The valve mechanism 202 may also comprise an insert 207 disposed coaxially with the axis of the downhole tool string component 200. The insert 207 may comprise a set of ports 222 and a second channel 223. The insert 207 may comprise a taper 208 adapted to concentrate the flow of the drilling fluid into the carrier 206.

The spring 205 may be adapted to resist the engagement of the fluid flow against the carrier 206. Without the fluid flow the ports may be misaligned due to the force of the spring. Once flow is added, the misaligned ports may obstruct the flow causing a pressure build-up. As the pressure increases the force of the spring may be overcome and eventual align the ports. Once the ports are aligned, the flow may pass through the ports relieving the pressure build-up such that the spring moves the carrier to misalign the ports.

This cycle of aligning and misaligning the carrier ports 220 and insert ports 222 aids in the advancing the drill string within its subterranean environments. As both sets of ports 220, 222 are misaligned, the pressure build up from the drilling fluid may cause the sidewall 230 of the downhole drill string component 200 to expand. As both sets of ports 220, 222 are aligned, the pressure build up from the drilling fluid may be released as the drilling fluid is allowed to flow from the first channel 221, through the ports 220, 222 and into the second channel 223. The shaft 203 and carrier 206 may be secured to each other by means of press-fitting the shaft 203 into the carrier 206 or shrink fitting the carrier 206 over the shaft 203. The shaft 203 may be allowed to move axially by a bearing 235 disposed intermediate the centralizer 218 and shaft 203.

Figure 3A:
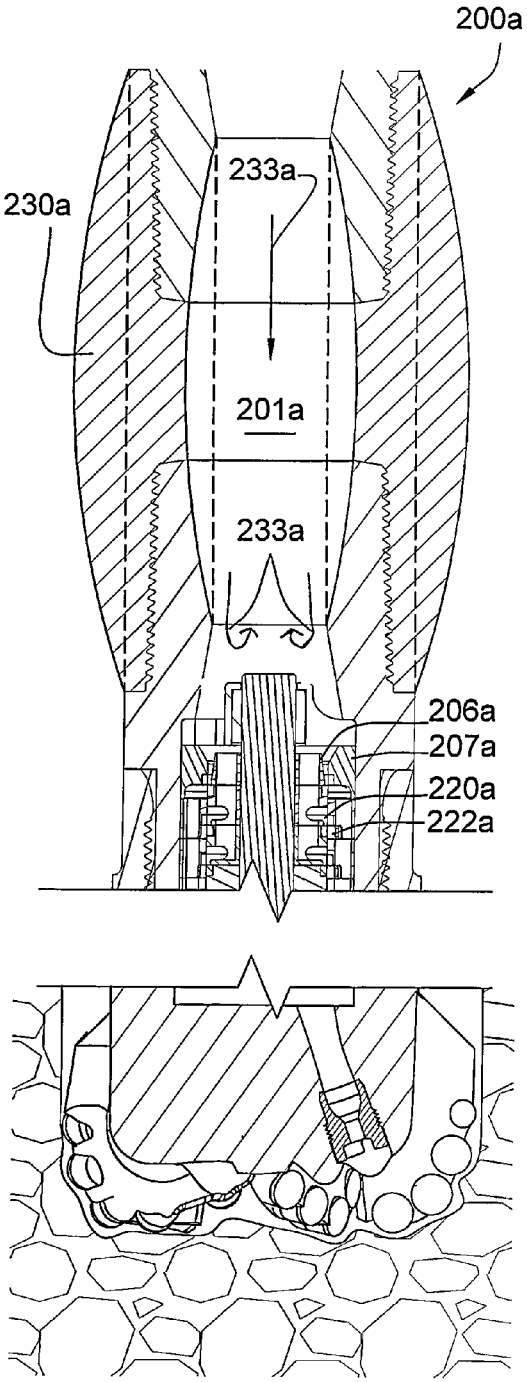
FIG. 3*a* is a cross-sectional diagram of another embodiment of a downhole tool string component.

FIG. 3*a* shows a cross-sectional diagram of another embodiment of a downhole tool string component 200*a*. With the ports 220*a* on the carrier 206*a* misaligned in relation to the ports 222*a* on the insert 207*a*, the drilling fluid 233*a* is allowed to build up within the central bore or fluid passageway 201*a* causing the sidewalls 230*a* of the downhole drill string component 200*a* to expand radially outward.

Figure 3B:
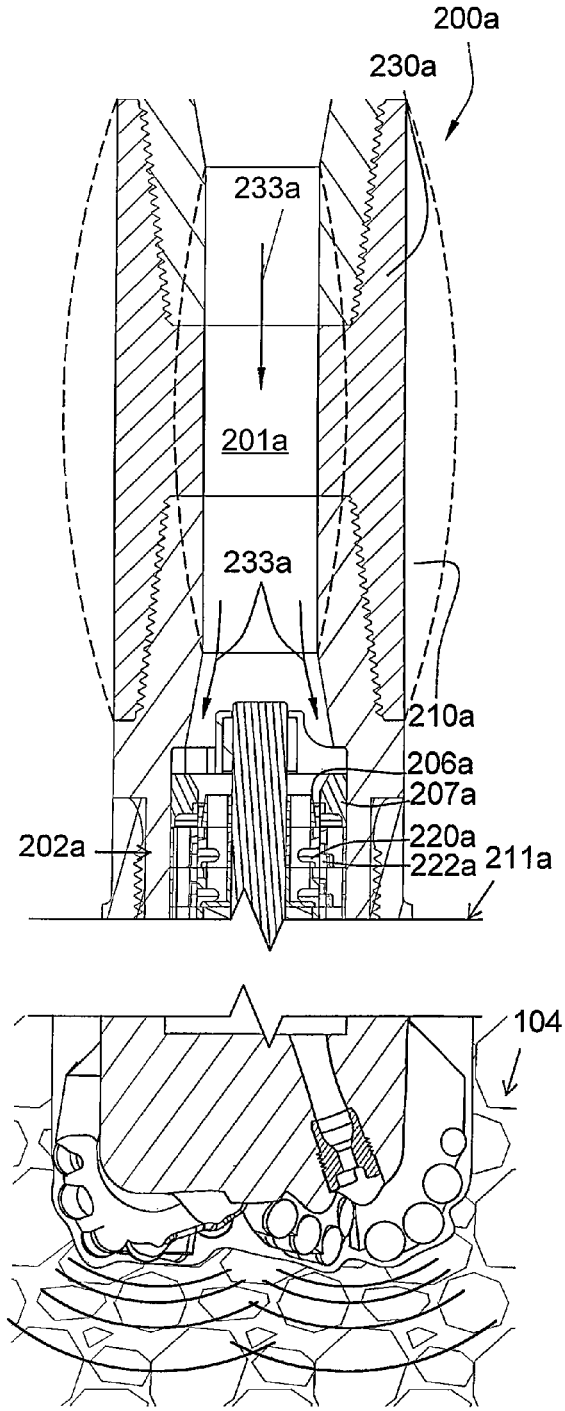
FIG. 3*b* is a cross-sectional diagram of another embodiment of a downhole tool string component.

FIG. 3*b* shows a cross-sectional diagram of another aspect of the embodiment of the downhole tool string component 200*a* showing in FIG. 3*a*. With the ports 220*a* on the carrier 206*a* aligned with the ports 222*a* on the insert 207*a*, the drilling fluid is allowed to pass from the first end 210 to the second end 211*a*, thus releasing the build up of pressure within the fluid passageway 201*a* and allowing the sidewalls 230*a* of the downhole drill string component 200*a* to radially contract back to their original position.

As the sidewall 230*a* of the downhole drill string component 200*a* or pipe radially contracts, the length of the downhole drill string component 200*a* or pipe is believed to expand axially. This axial expansion is believed to increase the weight loaded to the drill bit and transfer a pressure wave into the formation. In some embodiments, the pressure relief above the valve mechanism 202*a* will increase the pressure below the valve mechanism 202*a* thereby pushing against the drill bit 104, further increasing the weight loaded to the drill bit. Also in some embodiments the effect of the oscillating valve mechanism's mass will fluctuate the weight loaded to the drill bit.

Figure 4:
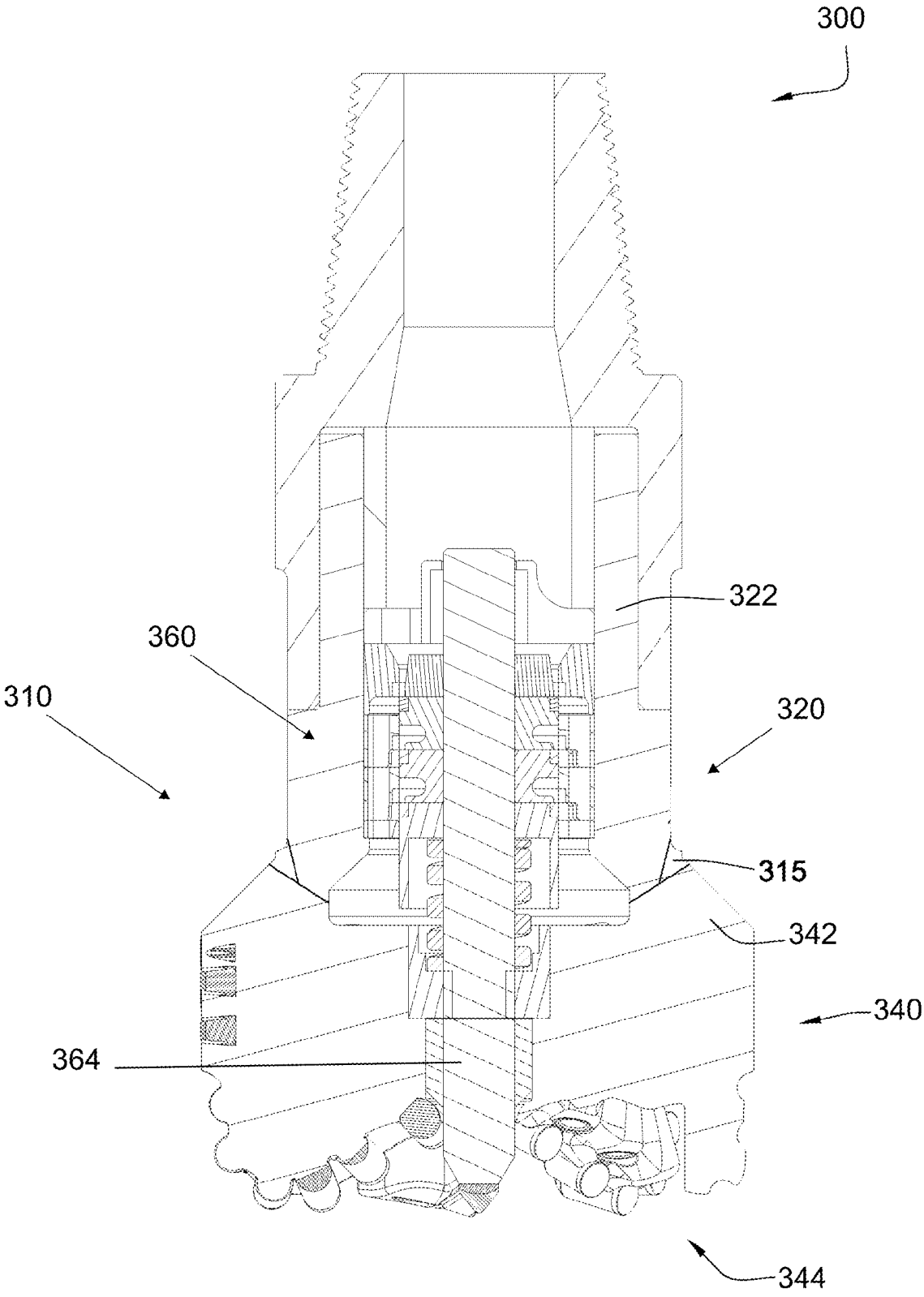
FIG. 4 is a cross-sectional diagram of an embodiment of a downhole tool string component with a drill bit.

FIG. 4 shows a cross-sectional diagram of a downhole drill string component 300 having a valve mechanism 360 installed within a drill bit 310. The drill bit 310 may be made in two portions. The first portion 320 may comprise the shank 322. The second portion 340 may comprise the working face 344 and the bit body 342. The two portions 320, 340 may be welded together or otherwise joined together at a joint 315. The drill bit 310 can further include a shaft 364 protruding out of its working face 344, and which shaft 364 can also form a portion of the valve mechanism 360.

Figure 5:
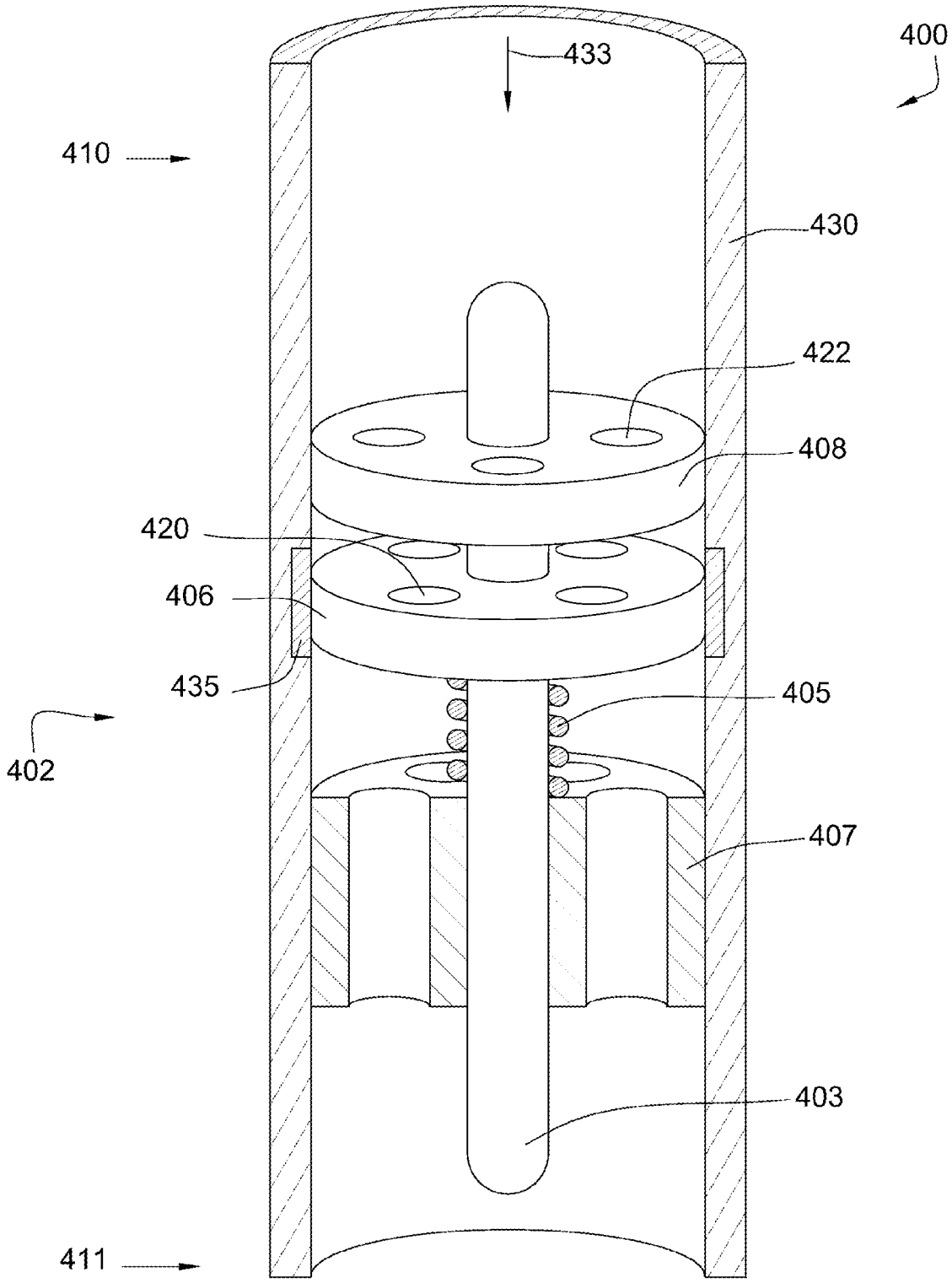
FIG. 5 is a cross-sectional diagram of another embodiment of a downhole tool string.

FIG. 5 shows a perspective diagram of another embodiment of a downhole tool string component 400. In this embodiment, the downhole tool string component 400 may comprise a valve mechanism 402. The valve mechanism 402 may comprise a carrier 406 which may be comprised of at least one hole 420 disposed on the carrier 406. The at least one hole 420 may be disposed offset at least one port 422 disposed on a guide 408 such that drilling fluid is unable to pass from the first end 410 to second end 411 if the carrier 406 is against the guide 408. The drilling fluid may follow the path indicated by the arrow 433. The guide 408 may be secured to the sidewalls 430 of the downhole drill string component 400 and may serve to align the shaft 403 axially with the downhole drill string component 400. A bearing 435 may be disposed intermediate the carrier 406 and the sidewall 430 of the downhole drill string component 400. The valve mechanism 402 may also comprise an insert 407 disposed intermediate the sidewall 430 of the downhole drill string component 400 and the shaft 403. A spring 405 may be disposed intermediate the insert 407 and the carrier 406 and coaxially with the downhole drill string component 400.

Figure 6:
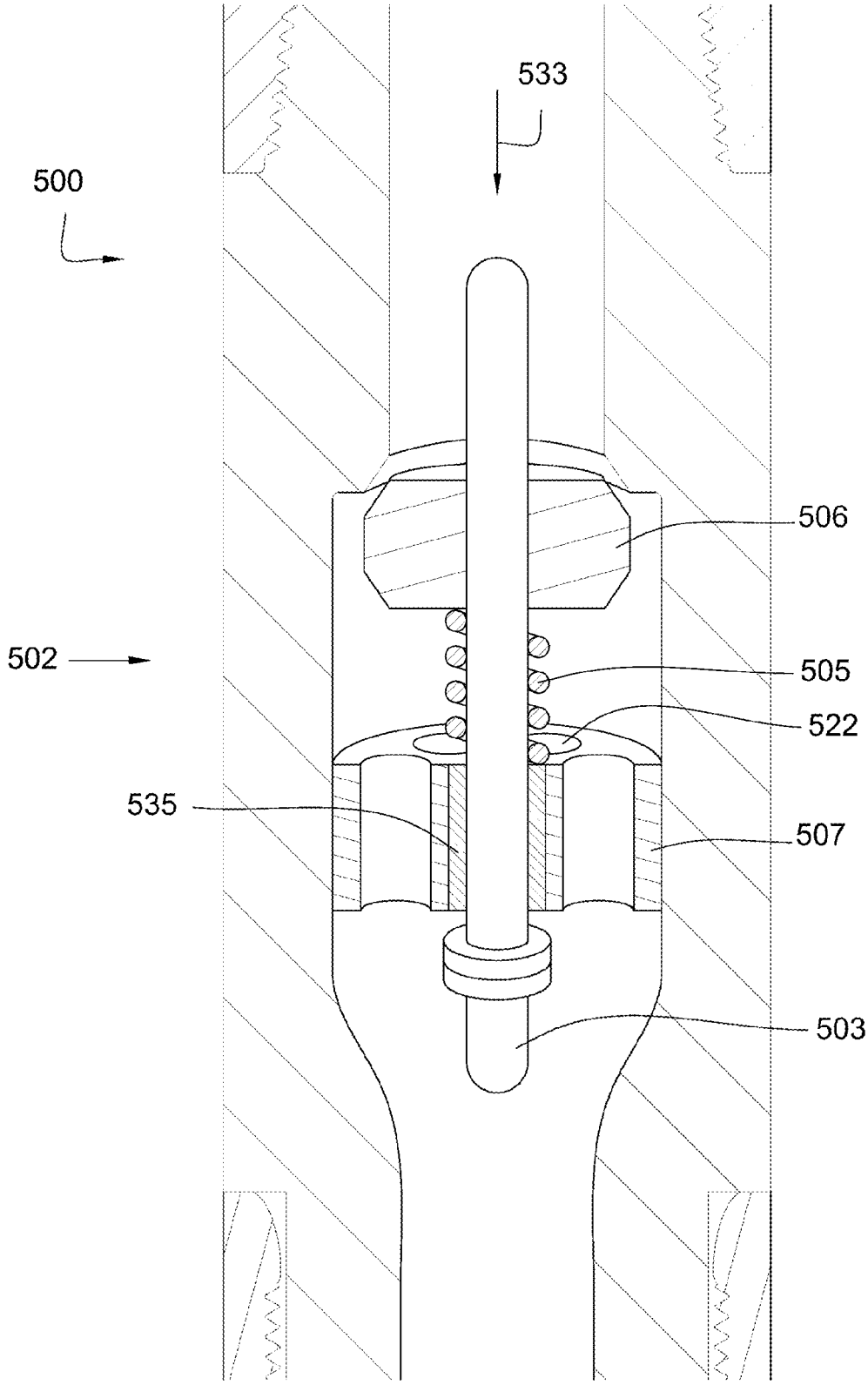
FIG. 6 is a cross-sectional diagram of another embodiment of a downhole tool string.

FIG. 6 shows a perspective diagram of another embodiment of a downhole tool string component 500. In this embodiment, the valve mechanism 502 may comprise a spring 505 disposed intermediate a carrier 506 and insert 507 and coaxially with the downhole tool string component 500. The insert 507 may comprise a set of ports 522 and a bearing 535 disposed intermediate a shaft 503 and the insert 507. The drilling fluid may follow the path indicated by the arrow 533.

Figure 7:
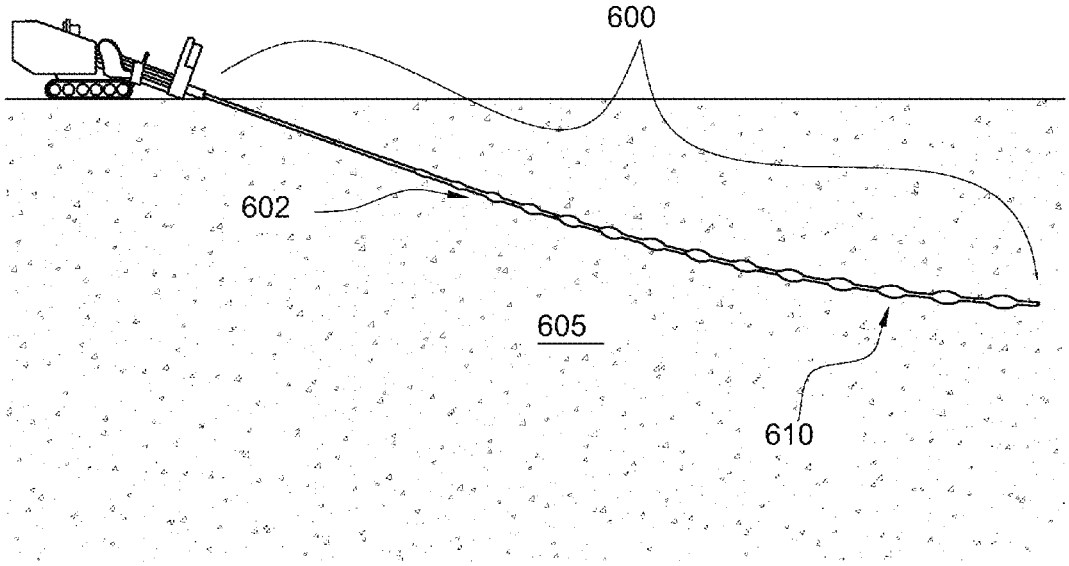
FIG. 7 is a perspective diagram of a tubular assembly.

FIG. 7 is a perspective diagram of a tubular assembly 600 penetrating into a subterranean environment 605. Preferable the tubular assembly 600 is a drill string which comprises a central bore for the passing drilling mud through. The tubular assembly 600 may comprise a mechanism for contracting and expanding a diameter of the tubular assembly such that a wave is generated which travels a portion of the length of the tubular assembly. This mechanism may be a valve mechanism such as any of the valve mechanisms described in FIGS. 2-6. In horizontal drilling applications the length 602 of the tubular assembly 600 may be engaged with the wall of the well bore and waves 610 may aid in moving the tubular assembly in its desired trajectory. In some embodiments of the present invention, the tubular assembly is not rotated such as in traditionally oil and gas exploration, but is propelling along its trajectory through the waves 610.

The tubular assembly may be used in oil and gas drilling, geothermal operations, exploration, and horizontal drilling such as for utility lines, coal methane, natural gas, and shallow oil and gas.

In one aspect of the present invention a method for penetrating a subterranean environment includes the steps of providing a tubular assembly with a oscillating valve mechanism disposed within its bore, the valve mechanism comprising the characteristic such that as a fluid is passing through the valve, the valve will oscillate between an open and closed position; generating a wave along a length of the tubular assembly by radially expanding and contracting the tubular assembly by increasing and decreasing a fluid pressure by oscillating the valve mechanism; and engaging the length the tubular assembly such that the wave moves the tubular assembly along a trajectory.

In another aspect of the present invention a method for penetrating a subterranean environment comprises the steps of providing a tubular assembly with a mechanism disposed within its bore adapted to expand and contract a diameter of the tubular assembly; generating a wave along a length of the tubular assembly by radially expanding and contracting a diameter of the tubular assembly; and engaging the length the tubular assembly such that the wave moves the tubular assembly along a trajectory.

Whereas the present invention has been described in particular relation to the drawings attached hereto, it should be understood that other and further modifications apart from those shown or suggested herein, may be made within the scope and spirit of the present invention.

What is claimed is:

1. A downhole tool string component comprising:

a first end and a second end spaced apart from the first end, and a central bore extending from the first end to the second end, the central bore for receiving and passing a fluid through the first end and the second end;

a valve mechanism disposed within the central bore, the valve mechanism operable to restrict a flow of the fluid through the central bore in a closed position and to allow the flow of the fluid through the central bore in an open position, the valve mechanism including:

a shaft;

a carrier coupled to the shaft;

a spring disposed around the shaft and configured to oppose a movement of the carrier generated by a fluid pressure of the fluid upon the carrier;

an insert having at least one port therein for the flow of fluid to pass through the insert; and, a sidewall having at least a portion capable of expanding and contracting in a radial direction under the influence of the fluid pressure in the central bore.

2. The downhole tool string component of claim 1, wherein the spring is disposed between the carrier and the insert.

3. The downhole tool string component of claim 1, further comprising at least one port in the carrier for the fluid to pass through the carrier, the port in the carrier being misaligned with the port of the insert when the valve mechanism is in the closed position and the port of the carrier being at least partially aligned with the port of the insert when the valve mechanism is in the open position.

4. The downhole tool string component of claim 3, wherein the carrier further comprises a channel connecting the central bore proximate the first end to the port in the carrier.

5. The downhole tool string component of claim 3, wherein the insert further comprises a channel connecting the port of the insert to the central bore proximate the second end.

6. The downhole tool string component of claim 1, further comprising a drill bit having a shank and a working face spaced apart from the shank.

7. The downhole tool string component of claim 6, wherein the valve mechanism is disposed within the drill bit.

8. The downhole tool string component of claim 7, wherein a portion of the shaft protrudes from the working face of the drill bit.

9. The downhole tool string component of claim 1, further comprising a length that decreases when the sidewall expands in the radial direction and increases when the sidewall contracts in the radial direction.

10. A downhole tool string component comprising:

a drill bit having a shank and a working face spaced apart from the shank;

a first end and a second end spaced apart from the first end, and a central bore extending from the first end to the second end, the central bore, the central bore for receiving and passing a fluid through the first end and the second end;

a valve mechanism disposed within the central bore and within the drill bit, the valve mechanism operable to restrict a flow of the fluid through the central bore in a closed position and to allow the flow of the fluid through the central bore in an open position; and a sidewall having at least a portion capable of expanding and contracting in a radial direction under the influence of a fluid pressure in the central bore.

11. The downhole tool string component of claim 10, further comprising:

a carrier;

a spring configured to oppose a movement of the carrier generated by a fluid pressure of the fluid upon the carrier; and, an insert having at least one port therein for the flow of fluid to pass through the insert.

12. The downhole tool string component of claim 11, further comprising a shaft coupled to the carrier.

13. The downhole tool string component of claim 12, wherein a portion of the shaft protrudes from the working face of the drill bit.

14. The downhole tool string component of claim 11, further comprising at least one port in the carrier for the fluid to pass through the carrier, the port in the carrier being misaligned with the port of the insert when the valve mechanism is in the closed position and the port of the carrier being at least partially aligned with the port of the insert when the valve mechanism is in the open position.

15. The downhole tool string component of claim 14, wherein the carrier further comprises a channel connecting the central bore proximate the first end to the port in the carrier.

16. The downhole tool string component of claim 14, wherein the insert further comprises a channel connecting the port of the insert to the central bore proximate the second end.

17. The downhole tool string component of claim 10, further comprising a length that decreases when the sidewall expands in the radial direction and increases when the sidewall contracts in the radial direction.

* * * * *